US009055651B1

(12) United States Patent
Radzinski et al.

(10) Patent No.: US 9,055,651 B1
(45) Date of Patent: Jun. 9, 2015

(54) CIRCUIT AND METHOD FOR MONITORING AND REPORTING THE REMAINING USEFUL LIFE OF AN LED MODULE

(71) Applicant: Universal Lighting Technologies, Inc., Madison, AL (US)

(72) Inventors: Christopher Radzinski, Huntsville, AL (US); John J. Dernovsek, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/031,902

(22) Filed: Sep. 19, 2013

Related U.S. Application Data

(60) Provisional application No. 61/702,860, filed on Sep. 19, 2012.

(51) Int. Cl.
*H05B 37/04* (2006.01)
*H05B 33/08* (2006.01)

(52) U.S. Cl.
CPC ..... *H05B 33/0893* (2013.01)

(58) Field of Classification Search
USPC ..... 315/129–136, 360
See application file for complete search history.

(56) References Cited

U.S. PATENT DOCUMENTS

| | | | | |
|---|---|---|---|---|
| 7,019,662 | B2 | 3/2006 | Shackle | |
| 8,111,388 | B2 | 2/2012 | Glandt et al. | |
| 2001/0045509 | A1 | 11/2001 | Al-Ali | |
| 2005/0206529 | A1 | 9/2005 | St.-Germain | |
| 2011/0101868 | A1 * | 5/2011 | Weiss | 315/130 |

OTHER PUBLICATIONS

Atlas Full Line Catalog 2012-2013, "Xitanium Programmable LED Drivers Leaflet," available on-line Apr. 21, 2014.

* cited by examiner

*Primary Examiner* — Jany Richardson
(74) *Attorney, Agent, or Firm* — Patterson Intellectual Property Law, P.C.; Mark J. Patterson

(57) ABSTRACT

A light source includes an operating time accumulator (i.e., counter or timer). The light source is operable to be powered by a driver circuit. The light source may be included in a light fixture or independently housed. The light source includes a controller integrally connected with a light emitting diode (LED) of the light source. Whenever the LED is receiving power from the driver circuit, the controller receives power from the driver circuit and accumulates an operating time in a nonvolatile memory of the controller. The nonvolatile memory includes blocks of bits arranged in a hierarchy. All of the bits of any block are in the same level of the hierarchy.

17 Claims, 5 Drawing Sheets

CIRCUIT AND METHOD FOR MONITORING AND REPORTING THE REMAINING USEFUL LIFE OF AN LED MODULE

CROSS-REFERENCES TO RELATED APPLICATIONS

This application claims priority to an incorporates by reference herein in its entirety U.S. Provisional Patent Application Ser. No. 61/702,860 entitled "Circuit and Method for Monitoring and Reporting the Remaining Useful Life of an LED Module" filed on Sep. 19, 2012.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to methods and circuits to enable identification of failure modes in light sources. More particularly, this invention pertains to circuits and methods for tracking light source usage time to facilitate failure mode recognition.

Light sources have useful lives generally ranging from thousands to millions of hours, depending on the type and configuration of the light source. Knowing an accumulated operating time of a failed light source is useful for warranty evaluation, end-of-life statistics, and failure mode evaluation. Particularly, end-of-life statistics for a light emitting diode based light source is not well known due to their long lifespans and relatively recent widespread use in various applications. Presently, accumulated operating time of a light source is measured only in laboratories, and those measurements are done with rudimentary methods utilizing stopwatches and estimations.

BRIEF SUMMARY OF THE INVENTION

Aspects of the present invention provide a light source including an operating time accumulator (i.e., counter or timer). The light source is powered by a driver circuit. The light source may be included in a light fixture or independently housed. The light source includes a controller integrally connected with a light emitting diode (LED) of the light source. Whenever the LED is receiving power from the driver circuit, the controller receives power from the driver circuit and accumulates an operating time in a nonvolatile memory of the controller. The nonvolatile memory includes blocks of bits arranged in a hierarchy. All of the bits of any block are in the same level of the hierarchy.

In one aspect, a light source includes a light emitting diode (LED) and a controller. The light emitting diode connects to a driver circuit and provides light in response to receiving power from the driver circuit. The controller is connected with the LED and receives power from the driver circuit when the driver circuit is providing power to the LED. The controller includes a counter and a nonvolatile memory. The counter periodically increments a count stored in a counter memory of the controller only when the controller is receiving power from the driver circuit. When the count reaches a predetermined limit, the controller restarts the count. The nonvolatile memory stores a representation of a number of times that the count has restarted.

In another aspect, a light fixture includes a light source, a driver circuit, and a housing. The light source includes a light emitting diode (LED) and a controller. The light emitting diode connects to a driver circuit and provides light in response to receiving power from the driver circuit. The controller is connected with the LED and receives power from the driver circuit when the driver circuit is providing power to the LED. The controller includes a counter and a nonvolatile memory. The counter periodically increments a count stored in a counter memory of the controller only when the controller is receiving power from the driver circuit. When the count reaches a predetermined limit, the controller restarts the count. The nonvolatile memory stores a representation of a number of times that the count has restarted. The driver circuit connects to the light source and provides power from a power source to the light source. The housing supports the light source and the driver circuit.

In another aspect, a method of determining an operating time of a light source begins with receiving power from a driver circuit at the light source. The light source includes an LED and a controller integrally connected with the LED. The LED provides light in response to receiving power from the driver circuit at the LED. In response to receiving power from the driver circuit at the controller, a counter of the controller periodically increments a count stored in a counter memory of the controller only when the controllers receiving power from the driver circuit. The controller restarts the count when the count reaches a predetermined limit. The controller stores a representation of a number of times the counter has restarted the count in a nonvolatile memory of the controller.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
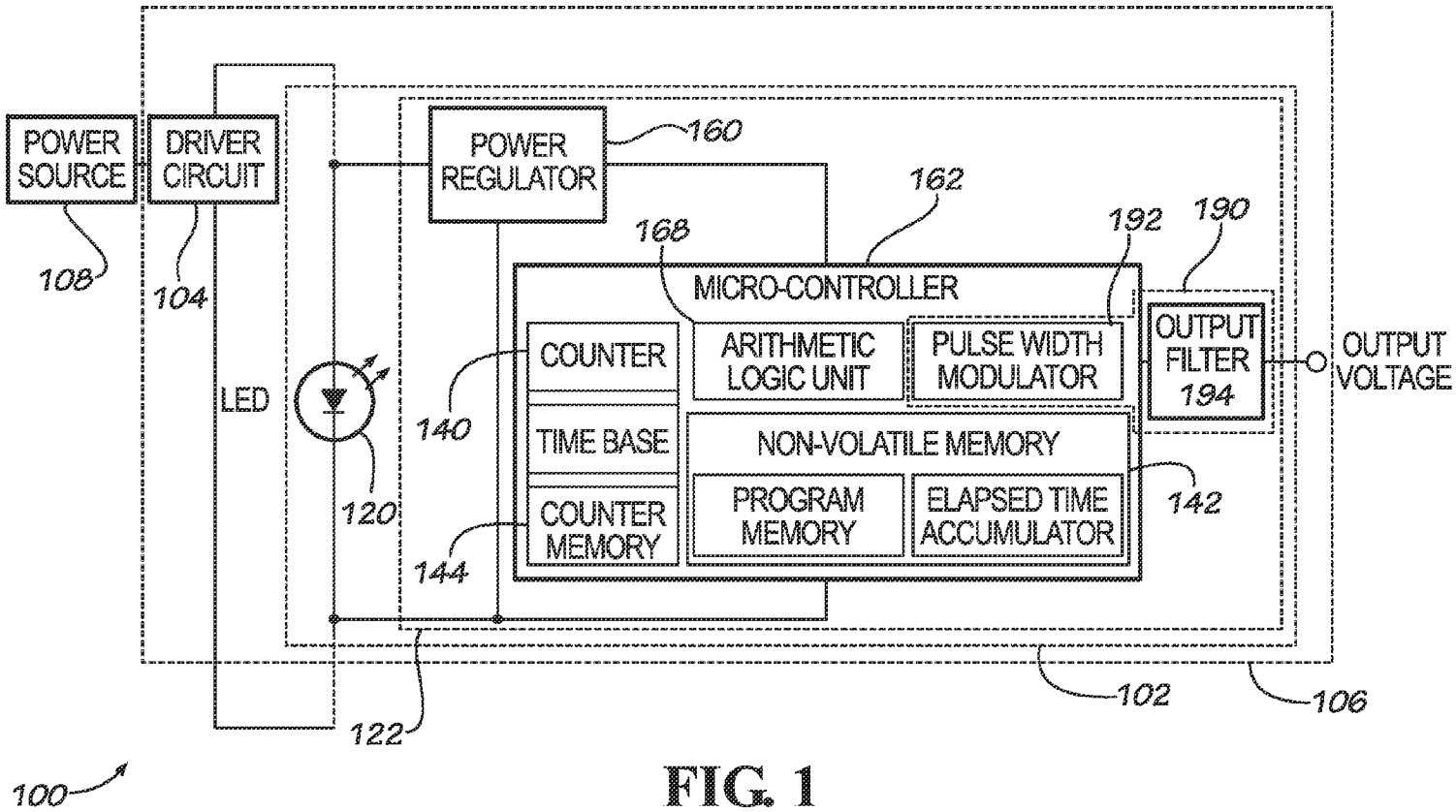
FIG. 1 is a block diagram of a light fixture including an operating time accumulator.
Figure 2:
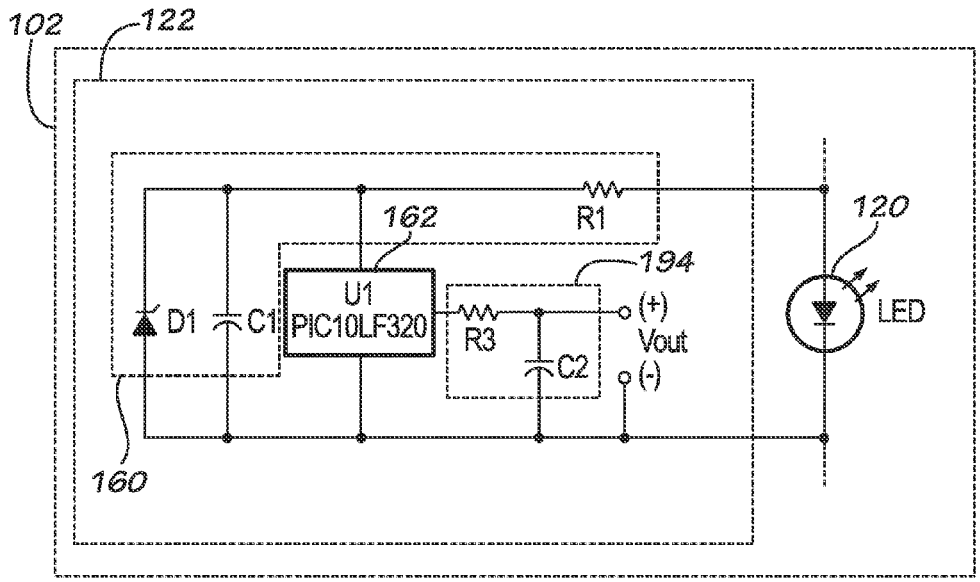
FIG. 2 is a block and partial schematic diagram of a light source including an operating time accumulator.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, "ballast" and "driver circuit" refer to any circuit for providing power (e.g., current) from a power source to a light source. Additionally, "light source" refers to one or more light emitting devices such as fluorescent lamps, high intensity discharge lamps, incandescent bulbs, and solid state light-emitting elements such as light emitting diodes (LEDs), organic light emitting diodes (OLEDs), and plasmaloids.

Referring to FIGS. 1-4, a light fixture 100 includes a light source 102, a driver circuit 104, and a housing 106. The driver circuit 104 connects to the light source 102 and to a power source 108. The driver circuit 104 receives power from the power source 108 and provides power to the light source 102. In one embodiment, the power source 108 is an alternating current (AC) line voltage (e.g., 115 V at 60 Hz), and the driver circuit 104 includes an AC to direct current (DC) converter and a buck boost DC-to-DC converter configured as a constant current source. The housing 106 is configured to support the light source 102 and the driver circuit 104. In one embodiment, the housing 106 further includes a light diffuser, a diffractor, or other lens positioned to distribute or focus light emitted by the light source 102.

Figure 3:
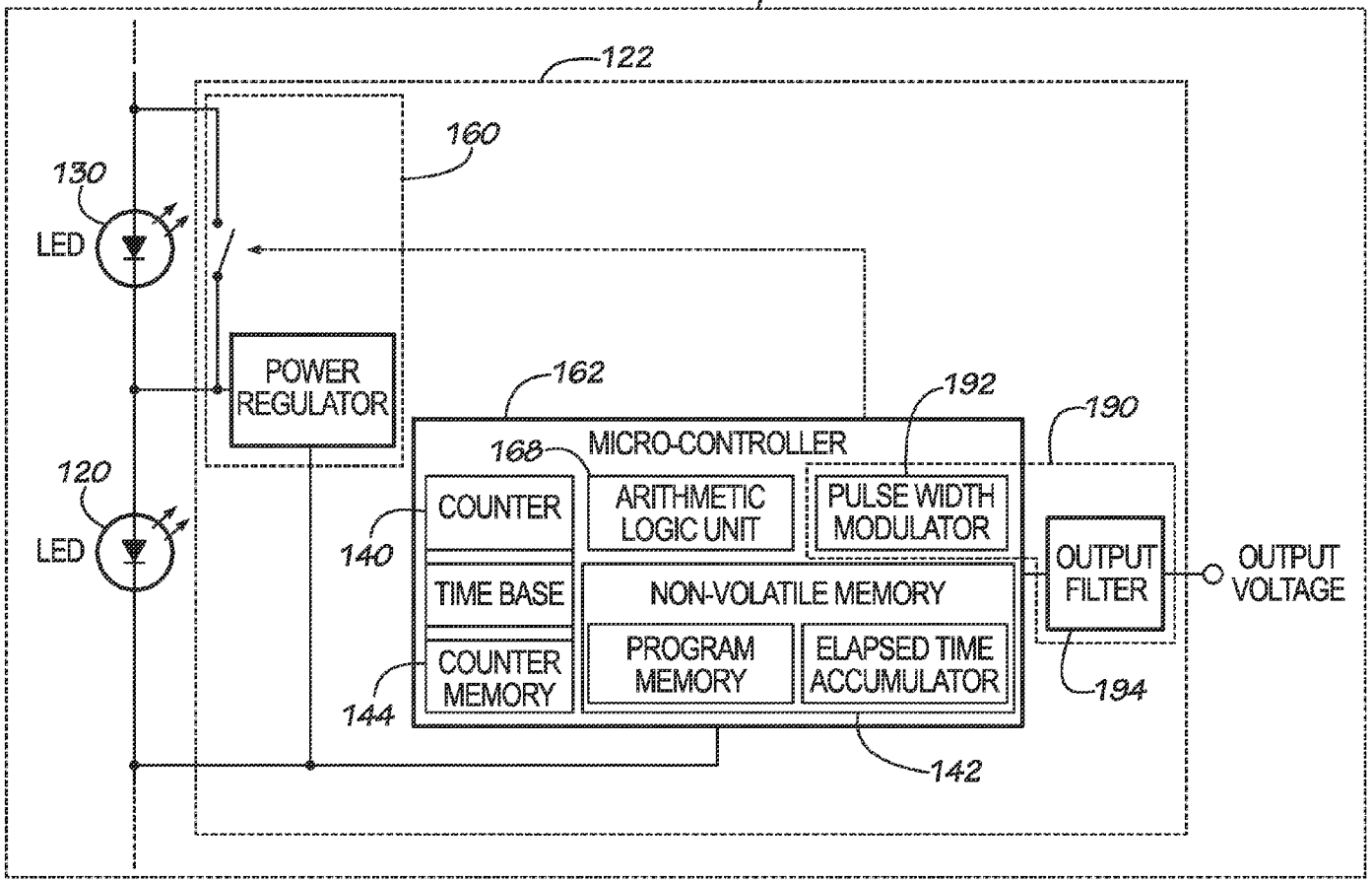
FIG. 3 is a block diagram of a light source including an operating time accumulator and a plurality of LEDs.
Figure 4:
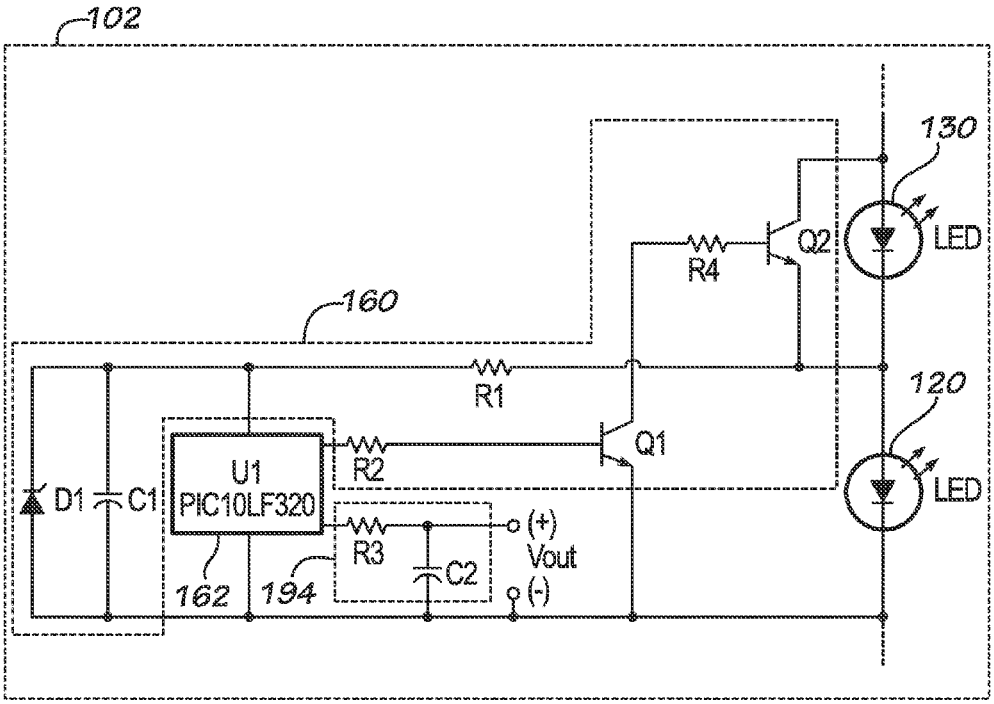
FIG. 4 is a block and partial schematic diagram of a light source including an operating time accumulator and a plurality of LEDs.

The light source 102 includes a light emitting diode 120 and a controller 122. The light emitting diode 120 receives power from the driver circuit 104 and provides light in response to receiving the power. As shown in FIGS. 3 and 4, it is contemplated that the light source 102 may include a plurality of LEDs (e.g., first LED 120 and second LED 130). The plurality of LEDs may be connected in series, parallel, or a combination thereof.

The controller 122 is integrally connected with the LED 120. As used herein, integrally connected with the LED 120 means that the controller 122 is electrically connected with the LED 120 such that whenever the LED 120 receives power from the driver circuit 104, the controller 122 also receives power from the driver circuit 104. In one embodiment, the controller 122 is configured to receive power only from the driver circuit 104 and to only receive power when the LED 120 is receiving power from the driver circuit 104.

The controller 122 includes a counter 140 and a nonvolatile memory 142. The counter 140 periodically increments a count stored in a counter memory 144 of the controller 122. In one embodiment, the counter memory 144 is a volatile memory integral with the counter. The counter 140 increments a count stored in the counter memory 144 only when the controller 140 is receiving power from the driver circuit 104. When the count reaches a predetermined limit, the controller 122 restarts the count.

The nonvolatile memory 142 stores a representation of a number of times the counter 140 has restarted the count. In one embodiment, the nonvolatile memory 142 includes a plurality of memory blocks, each block including a plurality of bits. The plurality of memory blocks are arranged in a numerical hierarchy including a plurality of levels. In one embodiment, all of the bits in any block are on the same level of the numerical hierarchy. In one embodiment, the predetermined limit is reached and the counter 140 resets approximately every 16 seconds.

Using a microprocessor 162 such as a PIC10LF320, which has 224 bits per block, a single block can accumulate approximately one hour in this example. Thus, without memory rotation algorithms, a single block can accurately accumulate total elapsed operating time to approximately 100,000 hours. Depending on the amount of nonvolatile memory 142 in the controller 122, a low cost controller implementing a block level hierarchal memory structure can thus store a representation of a number of times the count has reset that corresponds to millions of hours. In this context, hierarchal means counting in a base other than base 10. For example, with 224 bits per block, any one bit set in a second level block containing 224 bits represents 224 bits in the first level, or approximately 1 hour. Similarly, one bit set in a third level block represents 224 bits in the second level or approximately 50176 total bits. Thus, three hierarchal blocks can represent approximately 50,401 hours in this example.

In one embodiment, the controller 102 further includes a power regulator 160 and a microprocessor 162. The power regulator 160 is integrally connected with the LED 120. The power regulator 160 receives power from the driver circuit 104, regulates the received power to a stable voltage, and provides the stable voltage to the microprocessor 162. The power regulator 160 may operate at the voltage of a single LED 120, or may operate at the voltage developed across a plurality of LEDs (see FIGS. 3 and 4).

The microprocessor 162 includes the counter 140, the counter memory 144, the nonvolatile memory 142, and an arithmetic logic unit 168. The arithmetic logic unit 168 executes computer executable instructions stored in the nonvolatile memory 142. The nonvolatile memory 142 stores computer executable instructions for restarting the count by resetting the counter 140 to zero when the count reaches the predetermined limit, and for implementing the representation of the number of times that the counter has been restarted in the nonvolatile memory 142 in response to restarting the counter 140. It is contemplated that inverse logic may be used with respect to the counter 140 and the representation of the number of times that the counter 140 has been reset stored in the nonvolatile memory 142. That is, the counter 140 may count up (i.e., increment) from zero to the predetermined limit or count down (i.e., decrement) from another number to a predetermined limit (e.g., zero) within the scope of the claims. It is also contemplated that the nonvolatile memory 142 may be configured to increment from an expected life of the LED 120 down toward zero to accumulate the operational time of the LED 120.

In one embodiment, the controller 122 further includes an output circuit 190 to provide a signal indicative of the representation of the number of times that the counter 140 has been reset as stored by the nonvolatile memory 142. The output circuit 190 includes a pulse width modulator 192 and an output filter 194. The pulse width modulator 192 outputs a pulse width modulated output signal having a duty cycle corresponding to the representation of the number of times that the counter has been restarted. In one embodiment, the pulse width modulator 192 is integral with the microprocessor 162. In one embodiment, the arithmetic logic unit 160 executes computer executable program instructions stored in the nonvolatile memory 142 to determine the number of times that the counter has been restarted (i.e., reset) based on the accumulated data in the nonvolatile memory 142 and set the duty cycle of the pulse width modulated output signal as a function of the determined number. The output filter 194 smoothes the pulse width modulated output signal to a DC voltage. It is contemplated that the DC voltage may be measured with a handheld voltmeter to determine the accumulated operating time of the LED 120 or light source 102. Alternatively, additional circuitry may interpret the provided DC voltage to provide a user with a graphical representation of the accumulated (i.e., elapsed) operating time, or remaining operating time of the LED 120 or light source 102.

Figure 5:
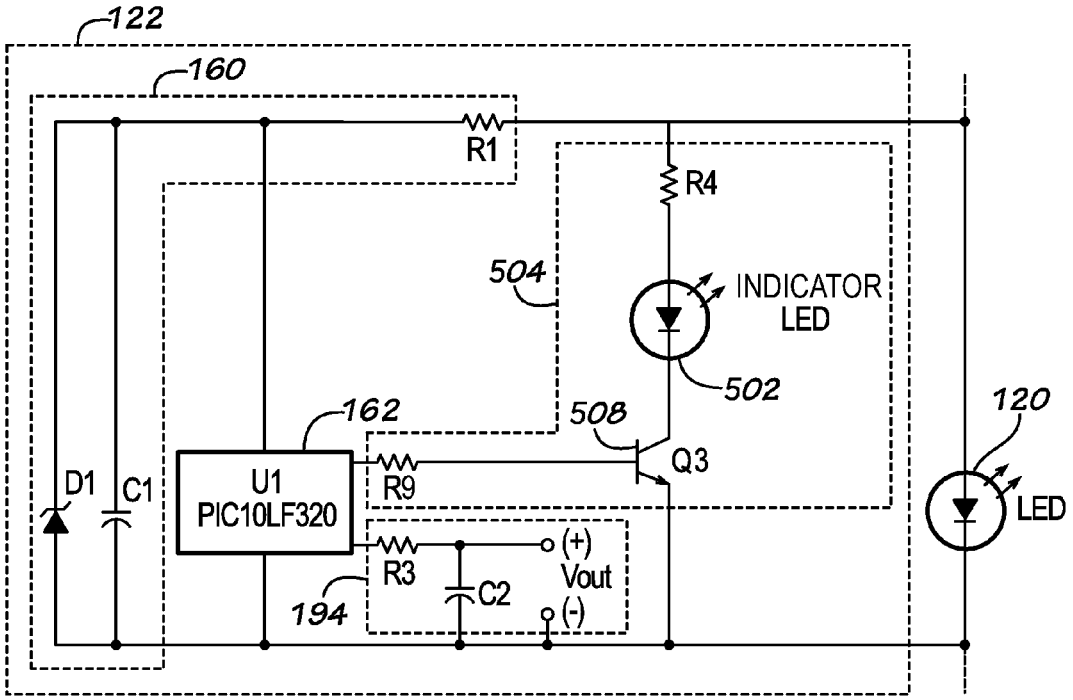
FIG. 5 is a block and partial schematic diagram of a light source including an operating time accumulator and an indicator LED.

Referring to FIG. 5, in one embodiment, the controller 122 further includes an end of life indicator circuit 504. The end of life indicator circuit 504 includes an indicator LED 502 and a switch 508. The indicator LED 502 is operable to provide light in response to receiving power from the driver circuit. In one embodiment, the indicator LED 502 is a narrow band LED or "colored" LED. That is, the indicator LED 502 appears, for example, red, green, or blue when receiving power (i.e., current) and providing light. The switch 508 is connected in series with the indicator LED 502. The switch 508 is responsive to an enable signal to selectively enable current form the driver circuit to the indicator LED 502. The controller 122 (e.g., the microprocessor 162) is operable to provide the enable signal to the switch 508 as a function of the representation of the number of times that the counter 140 has been restarted as stored by the nonvolatile memory 142. In operation, the controller 122 activates the indicator LED 502 via the switch 508 when the elapsed time or remaining life stored by the nonvolatile memory 142 reaches a predetermined limit such as an end of life time. In one embodiment, there are multiple predetermined limits triggering different actions as the accumulated elapsed time reaches the end of life time. For example, the controller 122 may increase the current provided to the indicator LED 502 (or an array of indicator LEDs 502) as the stored elapsed time approaches the end of life time. In another example, the controller 122 may flash the indicator LED 502 periodically with an increasing frequency and/or duration as the stored elapsed time approaches the end of life time. In another example, the controller 122 includes multiple indicator LEDs 502 (in one or more packages), each with a different color, and the controller 122 changes which indicator LED 502 is powered and providing light as the stored elapsed time approached the end of life time. For example, the controller 122 may enable power first to a green indicator LED 502, then to an orange indicator LED 502, and finally to a red indicator LED 502 when the stored elapsed time has exceeded the end of life time.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media. As used herein, server is not intended to refer to a single computer or computing device. In implementation, a server will generally include an edge server, a plurality of data servers, a storage database (e.g., a large scale RAID array), and various networking components. It is contemplated that these devices or functions may also be implemented in virtual machines and spread across multiple physical computing devices.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful CIRCUIT AND METHOD FOR MONITORING AND REPORTING THE REMAINING USEFUL LIFE OF AN LED MODULE it is not intended that such references be construed as limitations upon the scope of this invention except as set forth in the following claims.

What is claimed is:

1. A light source comprising:

a light emitting diode (LED) configured to connect to a driver circuit and operable to provide light in response to receiving power from the driver circuit;

a controller integrally connected with the LED and operable to receive power from the driver circuit when the driver circuit is providing power to the LED, said controller comprising a counter operable to periodically increment a count stored in a counter memory of the controller only when the controller is receiving power from the driver circuit, wherein when the count reaches a predetermined limit, the count restarts, and a nonvolatile memory operable to store a representation of a number of times the controller has restarted the count; and wherein the counter memory is a volatile memory, and the controller further comprises a power regulator integrally connected with the LED, wherein the power regulator is operable to receive power from the driver circuit, regulate the received power to a stable voltage, and provide the stable voltage, and a microprocessor operable to receive the stable voltage from the power regulator, wherein the controller is receiving power from the driver circuit when the microprocessor is receiving the stable voltage from the power regulator, said microprocessor comprising the counter, the counter memory, the nonvolatile memory, wherein the nonvolatile memory stores computer executable instructions for restarting the count by resetting the counter to zero when the count reaches the predetermined limit, and incrementing the representation of the number of times that the counter has been restarted in the nonvolatile memory in response to restarting the counter, and an arithmetic logic unit operable to execute the computer executable instructions stored in the nonvolatile memory.

2. The light source of claim 1, wherein the nonvolatile memory comprises a plurality of memory blocks, each memory block comprising a plurality of bits, and wherein the plurality of memory blocks are arranged in a numerical hierarchy comprising a plurality of levels.

3. The light source of claim 1, wherein the nonvolatile memory comprises a plurality of memory blocks, each block comprising a plurality of bits, the plurality of bits in a block of the plurality of memory blocks are all on one level of a numerical hierarchy of the memory blocks.

4. The light source of claim 1, wherein the controller receives power from the driver circuit only when the driver circuit is providing power to the LED, and the controller is configured to receive power only from the driver circuit.

5. A light source comprising:

a light emitting diode (LED) configured to connect to a driver circuit and operable to provide light in response to receiving power from the driver circuit; and a controller integrally connected with the LED and operable to receive power from the driver circuit when the driver circuit is providing power to the LED, said controller comprising a counter operable to periodically increment a count stored in a counter memory of the controller only when the controller is receiving power from the driver circuit, wherein when the count reaches a predetermined limit, the count restarts, and a nonvolatile memory operable to store a representation of a number of times the controller has restarted the count;

an output circuit operable to provide a signal indicative of the representation of the number of times that the counter has been restarted as stored by the nonvolatile memory; and an end of life indicator circuit comprising:

an indicator LED operable to provide light in response receiving power from the driver circuit;

a switch connected in series with the indicator LED, said switch responsive to an enable signal to selectively enable current from the driver circuit to the indicator LED, wherein the controller is further operable to provide the enable signal to the switch as a function of the representation of the number of times that the counter has been restarted as stored by the nonvolatile memory.

6. A light source comprising:

a light emitting diode (LED) configured to connect to a driver circuit and operable to provide light in response to receiving power from the driver circuit; and a controller integrally connected with the LED and operable to receive power from the driver circuit when the driver circuit is providing power to the LED, said controller comprising a counter operable to periodically increment a count stored in a counter memory of the controller only when the controller is receiving power from the driver circuit, wherein when the count reaches a predetermined limit, the count restarts, and a nonvolatile memory operable to store a representation of a number of times the controller has restarted the count;

an output circuit operable to provide a signal indicative of the representation of the number of times that the counter has been restarted as stored by the nonvolatile memory, wherein the output circuit comprises:

a pulse width modulator operable to output a pulse width modulated output signal having a duty cycle corresponding to the representation of the number of times that the counter has been restarted; and an output filter effective to smooth the pulse width modulated output signal to a direct current (DC) voltage.

7. A light fixture comprising:

a light source comprising a light emitting diode (LED) operable to receive power and provide light in response to receiving power, and a controller integrally connected with the LED and operable to receive power from the driver circuit when the driver circuit is providing power to the LED, said controller comprising a counter operable to periodically increment a count stored in a counter memory of the controller only when the controller is receiving power from the driver circuit, wherein when the count reaches a predetermined limit, the count restarts, and a nonvolatile memory operable to store a representation of a number of times the controller has restarted the count;

a driver circuit operable to connect to the light source and provide power from a power source to the light source;

a housing configured to support the light source and the driver circuit; and wherein the controller further comprises an output circuit operable to provide a signal indicative of the representation of the number of times that the counter has been restarted as stored by the nonvolatile memory, wherein the output circuit comprises a pulse width modulator operable to output a pulse width modulated output signal having a duty cycle corresponding to the representation of the number of times that the counter has been restarted; and an output filter effective to smooth the pulse width modulated output signal to a direct current (DC) voltage.

8. The light fixture of claim 7, wherein the nonvolatile memory comprises a plurality of memory blocks, each memory block comprising a plurality of bits, and the plurality of memory blocks are arranged in a numerical hierarchy comprising a plurality of levels.

9. The light fixture of claim 7, wherein the nonvolatile memory comprises a plurality of memory blocks, each memory block comprising a plurality of bits, wherein the plurality of bits in a block of the plurality of memory blocks are all on one level of a numerical hierarchy of the memory blocks.

10. The light fixture of claim 7, wherein the controller receives power from the driver circuit only when the driver circuit is providing power to the LED, and the controller is configured to receive power only from the driver circuit.

11. The light fixture of claim 7, wherein the controller further comprises:

an output circuit effective to provide a signal indicative of the representation of the number of times that the counter has been restarted as stored by the nonvolatile memory.

12. A light fixture comprising:

a light source comprising a light emitting diode (LED) operable to receive power and provide light in response to receiving power, and a controller integrally connected with the LED and operable to receive power from the driver circuit when the driver circuit is providing power to the LED, said controller comprising a counter operable to periodically increment a count stored in a counter memory of the controller only when the controller is receiving power from the driver circuit, wherein when the count reaches a predetermined limit, the count restarts, and a nonvolatile memory operable to store a representation of a number of times the controller has restarted the count;

a driver circuit operable to connect to the light source and provide power from a power source to the light source; and a housing configured to support the light source and the driver circuit;

wherein the counter memory is a volatile memory and the controller further comprises:

a power regulator integrally connected with the LED, wherein the power regulator is operable to receive power from the driver circuit, regulate the received power to a stable voltage, and provide the stable voltage; and a microprocessor operable to receive the stable voltage from the power regulator, wherein the controller is receiving power from the driver circuit when the microprocessor is receiving the stable voltage from the power regulator, said microprocessor comprising the counter, the counter memory, the nonvolatile memory wherein the nonvolatile memory stores computer executable instructions for restarting the count by resetting the counter to zero when the count reaches the predetermined limit, and incrementing the representation of the number of times that the counter has been restarted in the nonvolatile memory in response to restarting the counter, and an arithmetic logic unit operable to execute the computer executable instructions stored in the nonvolatile memory.

13. A method of determining an operating time of a light source, said method comprising:

receiving power from a driver circuit at the light source, said light source comprising a light emitting diode (LED) and a controller and integrally connected with the LED;

providing light from the LED in response to receiving power from the driver circuit at the LED;

in response to receiving power from the driver circuit at the controller, periodically incrementing, via a counter of the controller, a count stored in a counter memory of the controller only when the controller is receiving power from the driver circuit;

restarting the count when the count reaches a predetermined limit;

storing a representation of a number of times the controller has restarted the count in a nonvolatile memory of the controller; and wherein the controller provides a pulse width modulated output signal, via pulse width modulator of the controller, wherein the pulse width modulated output signal has a duty cycle corresponding to the representation of the number of times that the counter has been restarted as stored by the nonvolatile memory; and smoothes, via an output filter of the controller, the pulse width modulated output signal to a direct current (DC) voltage.

14. The method of claim 13, wherein the nonvolatile memory comprises a plurality of memory blocks, each memory block comprising a plurality of bits, and the plurality of memory blocks are arranged in a numerical hierarchy comprising a plurality of levels.

15. The method of claim 13, wherein the nonvolatile memory comprises a plurality of memory blocks, each memory block comprising a plurality of bits, the plurality of bits in a block of the plurality of memory blocks are all on one level of a numerical hierarchy of the memory blocks.

16. The method of claim 13, wherein the controller receives power from the driver circuit only when the driver circuit is providing power to the LED, and the controller is configured to receive power only from the driver circuit.

17. The method of claim 13, further comprising:

providing a signal representative of the number of times that the counter has been restarted as stored by the non-volatile memory via an output circuit of the controller.

* * * * *